US011822268B2

(12) United States Patent
Fujiwara

(10) Patent No.: US 11,822,268 B2
(45) Date of Patent: Nov. 21, 2023

(54) IMAGE FORMING APPARATUS

(71) Applicant: Canon Kabushiki Kaisha, Tokyo (JP)

(72) Inventor: Yuji Fujiwara, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/582,196

(22) Filed: Jan. 24, 2022

(65) Prior Publication Data

US 2022/0236675 A1 Jul. 28, 2022

(30) Foreign Application Priority Data

Jan. 25, 2021 (JP) ..... 2021-009483

(51) Int. Cl.
*G03G 15/20* (2006.01)
*G03G 15/00* (2006.01)

(52) U.S. Cl.
CPC ..... *G03G 15/2039* (2013.01); *G03G 15/5045* (2013.01)

(58) Field of Classification Search
CPC ..... G03G 15/2039; G03G 15/5045
See application file for complete search history.

(56) References Cited

U.S. PATENT DOCUMENTS

2011/0280597 A1* 11/2011 Shimura ..... G03G 15/2039 399/37

FOREIGN PATENT DOCUMENTS

| | | | |
|---|---|---|---|
| JP | 2003123941 | A | 4/2003 |
| JP | 2004240280 | A | 8/2004 |
| JP | 2007110839 | A | 4/2007 |
| JP | 2013029746 | A | 2/2013 |

* cited by examiner

*Primary Examiner* — Stephanie E Bloss
*Assistant Examiner* — Michael A Harrison
(74) *Attorney, Agent, or Firm* — Venable LLP

(57) ABSTRACT

An image forming apparatus includes an image forming portion, a heating portion that includes a heating element which is heated by power from a power supply and heats an image, a temperature detecting portion that detects temperature of the heating portion, and a power control portion that controls power supplied to the heating element based on information from the temperature detecting portion. The image forming apparatus further includes a detecting portion that detects whether voltage from the power supply exceeds a rated value, and when the detecting portion detects that the voltage from the power supply exceeds the rated value, the power control portion controls the power supply such that a waveform pattern of an electric current to the heating element in one control cycle becomes a waveform pattern of phase control, where power supplying time to the heating element in one half wave becomes a predetermined time or less.

8 Claims, 10 Drawing Sheets

IMAGE FORMING APPARATUS

BACKGROUND OF THE INVENTION

Field of the Invention

The present invention relates to an image forming apparatus, such as a printer and a copier, using an electrophotographic system. The present invention also relates to an image heating apparatus, such as a glossing apparatus, that improves a gloss value of a toner image, by reheating the toner image fixed to a fixing unit equipped in the image forming apparatus, or to a recording material.

Description of the Related Art

In order to implement both reducing higher harmonic waves generated from the electric current applied from a commercial AC power supply to a fixing apparatus (image heating apparatus) and decreasing flickers in the image heating apparatus, controlling a waveform pattern of an electric current that flows through the heating elements of a heater has been performed. For example, Japanese Patent Application Publication No. 2003-123941 discloses a control in which: a phase control is used for at least one half wave out of a control cycle, which is a multiple of one half wave of a commercial frequency; and a wave number control is used for the other half wave, where power is supplied continuously or not supplied at all.

SUMMARY OF THE INVENTION

In a case where overvoltage outside the rating is applied to an image heating apparatus equipped in the image forming apparatus under a conventional heating element control system, overvoltage may be applied to the heating elements inside the image heating apparatus. Therefore sufficient countermeasures must be taken to prevent damage to the heating elements.

It is an object of the present invention to provide a technique to suppress overvoltage applied to the heating elements.

To solve this problem, an image forming apparatus of the present invention includes:

- an image forming portion that forms an image on a recording material;
- a heating portion that includes a heating element which is heated by power supplied from a commercial AC power supply and heats an image formed by the image forming portion;
- a temperature detecting portion that detects temperature of the heating portion; and
- a power control portion that controls power supplied from the commercial AC power supply to the heating element based on temperature information detected by the temperature detecting portion, wherein
- the image forming apparatus further comprises a detecting portion that detects whether voltage applied from the commercial AC power supply exceeds a rated value, wherein
- in a case where the detecting portion detects that the voltage applied from the commercial AC power supply exceeds the rated value, the power control portion controls the power supply such that a waveform pattern of an electric current flowing to the heating element in one control cycle becomes a waveform pattern of phase control, where power supplying time to the heating element in one half wave becomes a predetermined time or less.

As described above, according to the present invention, overvoltage applied to the heating elements can be suppressed, hence damage to the heating element can be avoided.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiment 1

Figure 1:
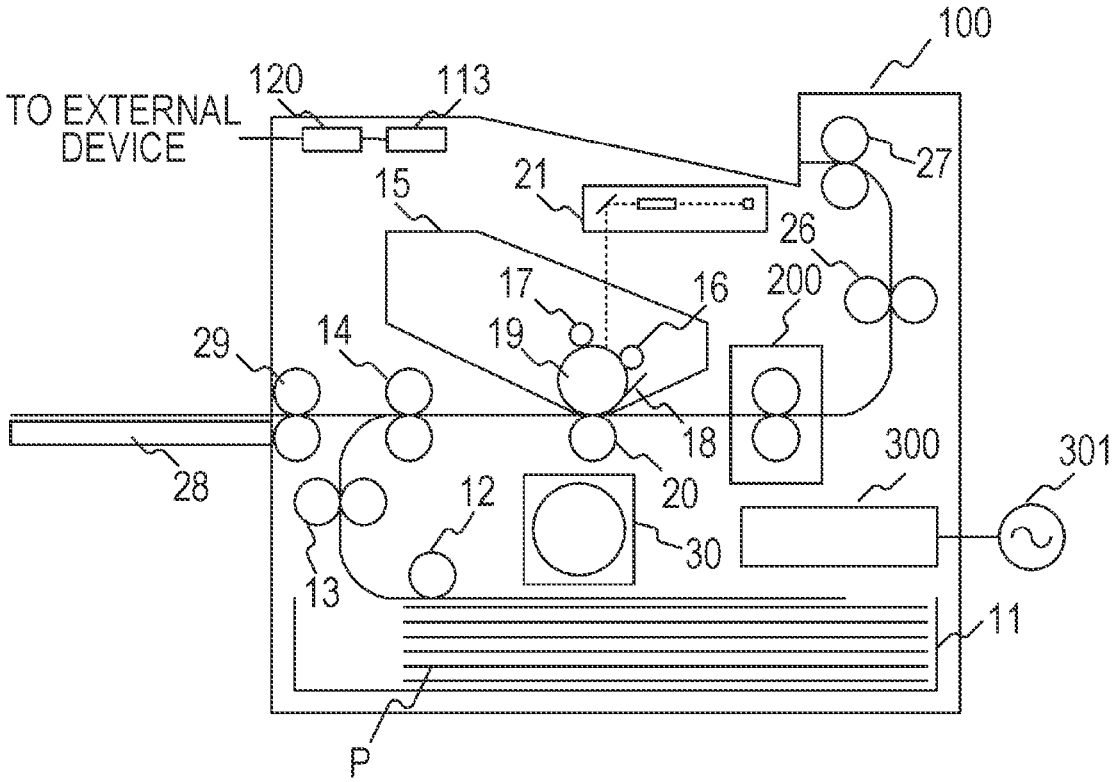
FIG. 1 is a schematic diagram of an image forming apparatus of Embodiment 1.

FIG. 1 is a schematic cross-sectional view of an image forming apparatus 100 using an electrophotographic recording system according to an embodiment of the present invention. Image forming apparatuses to which the present invention is applicable are a copier and a printer that use an electrophotographic system or an electrostatic recording system, and a case of applying the present invention to a laser printer, which forms an image on a recording paper P (recording material) using the electrophotographic system, will be described.

The image forming apparatus 100 includes a video controller 120 and a control portion 113. As an acquisition portion that acquires information on an image to be formed on the recording material, the video controller 120 receives and processes image information and print instructions which are sent from such an external device as a personal computer. The control portion 113 is connected with the video controller 120, and controls each composing element constituting the image forming apparatus 100, in accordance with an instruction from the video controller 120. When the video controller 120 receives a print instruction from an external device, the following operation to form an image is executed.

When an image forming apparatus main body 100 receives a print signal, a scanner unit 21 emits a laser beam, which has been modulated in accordance with the image information, and scans the surface of a photosensitive drum 19, which has been charged to a predetermined polarity by a charging roller 16, with the laser light. Thereby an electrostatic latent image is formed on the photosensitive drum 19. When toner is supplied from a developing roller 17 to this electrostatic latent image on the photosensitive drum 19, the electrostatic latent image is developed as a toner image. On the other hand, recording materials (recording paper) P loaded on a paper feeding cassette 11 are fed one by one by a pickup roller 12, and are conveyed toward a resist roller pair 14 by a conveying roller pair 13. At a timing when the toner image on the photosensitive drum 19 reaches a transfer position, constituted of the photosensitive drum 19 and a transfer roller 20, the recording material P is conveyed from the resist roller pair 14 to the transfer position. While the recording material P passes through the transfer position, the toner image on the photosensitive drum 19 is transferred to the recording material P. Then the recording material P is heated by a fixing apparatus (fixing portion) 200, which is an image heating apparatus (image heating portion), whereby the toner image is heat-fixed to the recording material P. The recording material P bearing the fixed toner image is discharged to a tray, which is located on the upper part of the image forming apparatus 100, by a conveying roller pair 26 and 27. A drum cleaner 18 cleans toner remaining on the photosensitive drum 19. A paper feeding tray 28 (manual feeding tray), which is a pair of recording material restriction plates and of which width can be adjusted in accordance with the size of the recording material P, is disposed to support a recording material P of which size is substandard. A pickup roller 29 feeds the recording material P from the paper feeding tray 28. The image forming apparatus main body 100 includes a motor 30 that dives the fixing apparatus 200 and the like.

A control circuit 300, which is a power control portion connected to a commercial AC power supply 301, supplies power to the fixing apparatus 200. The above mentioned photosensitive drum 19, charging roller 16, scanner unit 21, developing roller 17 and transfer roller 20 constitute an image forming portion that forms an unfixed image on a recording material P. In Embodiment 1, a developing unit including the photosensitive drum 19, the charging roller 16 and the developing roller 17, and a cleaning unit including the drum cleaner 18, are configured as a process cartridge 15, which is attachable to/detachable from the apparatus main body of the image forming apparatus 100. The fixing apparatus 200 is also configured to be attachable to/detachable from the image forming apparatus 100.

Figure 2A:
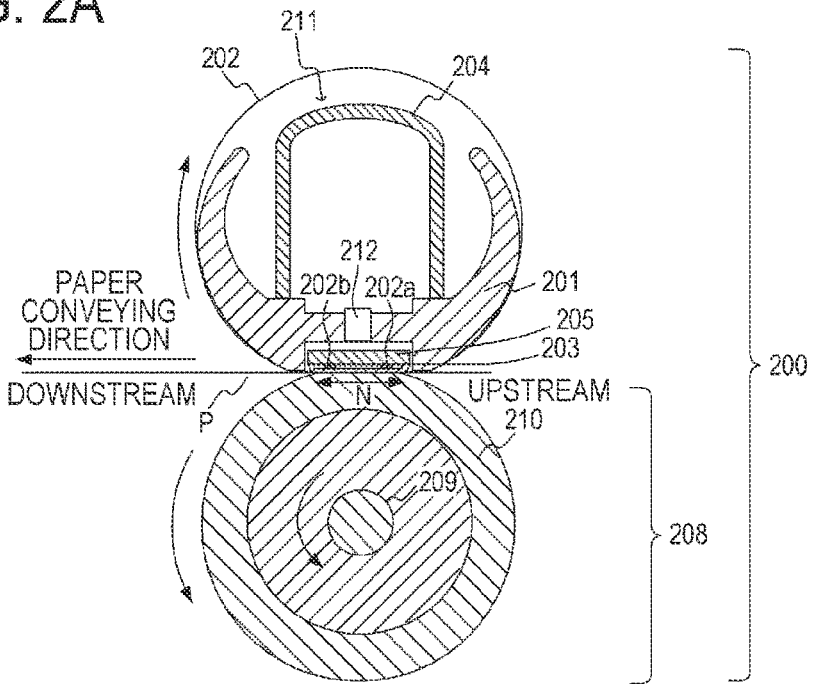
FIGS. 2A to 2C are schematic diagrams of an image heating apparatus of Embodiment 1.

FIG. 2A is a schematic cross-sectional view of the fixing apparatus 200, which is the image heating apparatus of Embodiment 1. The fixing apparatus 200 includes a fixing film (hereafter referred to as "film") 202, which is an endless belt, a heater 203 which contacts with the inner surface of the film 202, a pressure roller 208 which is press-contacted to the heater 203 via the film 202, and a metal stay 204. The pressure roller (nip forming member) 208 is press-contacted to the outer surface of the film 202, and the pressure roller 208 and the heater 203 form a fixing nip N.

The film 202 is a cylindrical multilayer heat resistant film, and the material of the base layer is a heat resistant resin (e.g. polyimide), or a metal (e.g. stainless steel). An elastic layer (e.g. heat resistant rubber) may be disposed on the surface layer of the film 202. A temperature detecting portion 212 (e.g. thermistor) contacts with the heater 203. The pressure roller 208 includes a core metal 209 (e.g. iron, aluminum) and an elastic layer 210 (e.g. silicon rubber). The heater 203 is held on the inner side of the film 202 by a holding member 201 made of heat resistant resin. The holding member 201 also has a guide function to guide the rotation of the film 202. The metal stay 204 is configured to apply pressure of a spring (not illustrated) to the holding member 201. The heater 203, the holding member 201 and the stay 204 constitute a heater unit 211. Such a member as a heat transfer member may be disposed between the film 202 and the heater 203. The pressure roller 208 rotates in the arrow direction by power received from the motor 30. The film 202 is rotated by the rotation of the pressure roller 208. The recording paper P bearing an unfixed toner image is held and conveyed by the fixing nip N, during which heating and fixing processing are performed.

Figure 2B:
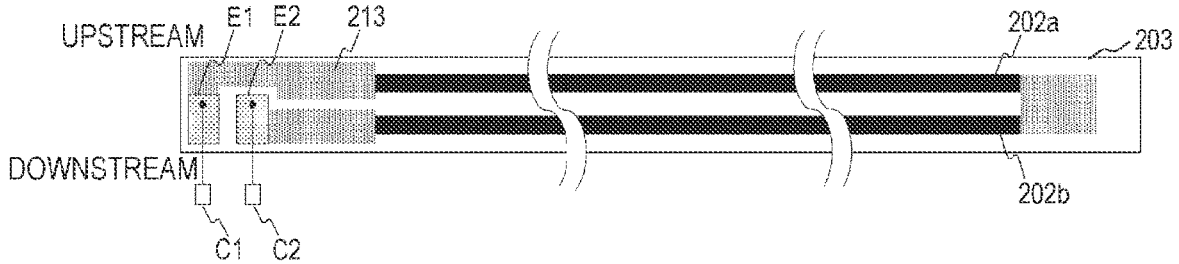

FIG. 2B indicates an example of the heater 203, and is heated by heating elements (heating resistors) 202*a* and 202*b* disposed on a ceramic substrate. The power supplied from the later mentioned C1 and C2 of the control circuit 300 is supplied to the heating elements 202*a* and 202*b* via the electrodes E1 and E2 and the conductor 213 disposed on the ceramic heater.

Figure 2C:
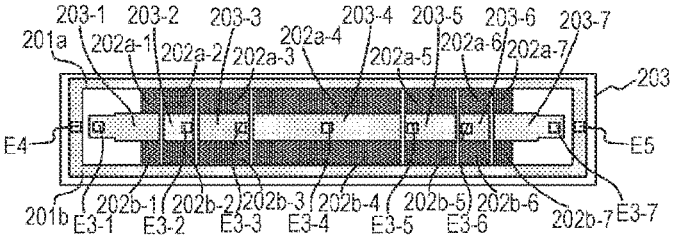

FIG. 2C also indicates an example of the heater 203. Heating elements 202*a* and 202*b* disposed on a ceramic substrate are divided into heating element 202*a*-1 to heating element 202*a*-7, and heating element 202*b*-1 to heating element 202*b*-7 respectively in the longitudinal direction. Thereby a heating zone of the respective heating elements can be controlled in accordance with the paper size of the recording paper P in the longitudinal direction of the ceramic heater. Each of E3-1 to E3-7 disposed on each of conductors 203-1 to 203-7 is an electrode of each heating element, and power is supplied to each heating element by supplying power to the electrode of each heating element and the electrodes E4 and E5 disposed between a conductor 201*a* and a conductor 201*b*.

Figure 3:
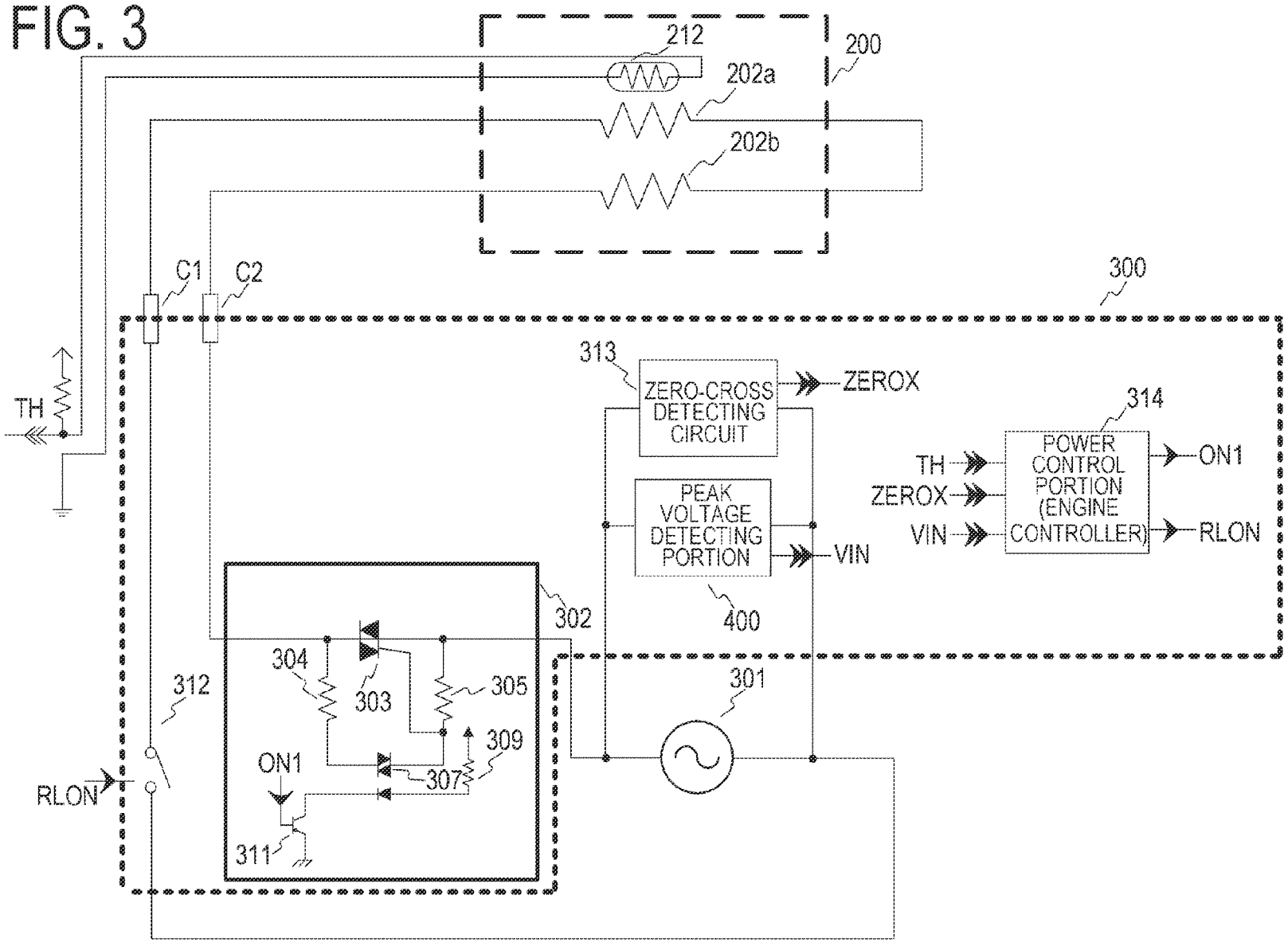
FIG. 3 is a control circuit diagram according to Embodiment 1.

FIG. 3 indicates the control circuit 300 according to Embodiment 1, that supplies power from the commercial AC power supply 301 to the fixing apparatus 200. The control circuit 300 is constituted of a power supply portion 302, a zero-cross detecting circuit portion 313, a peak voltage detecting portion 400, a relay 312, and a power control portion 314 (hereafter referred to as "engine controller 314"). The power supply portion 302 is connected to one side of the commercial power supply 301, and is connected to the fixing apparatus 200 via a connection terminal C2. The electric current flows to a photo triac coupler 307 via a transistor 311 by an ON1 signal outputted from the engine controller 314. As a result, the electric current flows into a gate of the triac 303, whereby the triac is turned ON and the electric current flows to the triac 303. The zero-cross detecting circuit portion 313 and the peak voltage detecting portion 400 are both connected to the commercial AC power supply 301. The zero-cross detecting circuit portion 313 outputs a zero-cross signal, which indicates a zero-cross point of the commercial AC waveform, to the engine controller 314. The peak voltage detecting portion 400 outputs the information VIN on the peak voltage of the commercial AC waveform to the engine controller 314. Based on the temperature information sent from the temperature detecting portion 212 inside the fixing apparatus 200, the engine controller 314 controls the power supply portion 302 via the ON1 signal, so that the detected temperature becomes a predetermined temperature.

Figure 4:
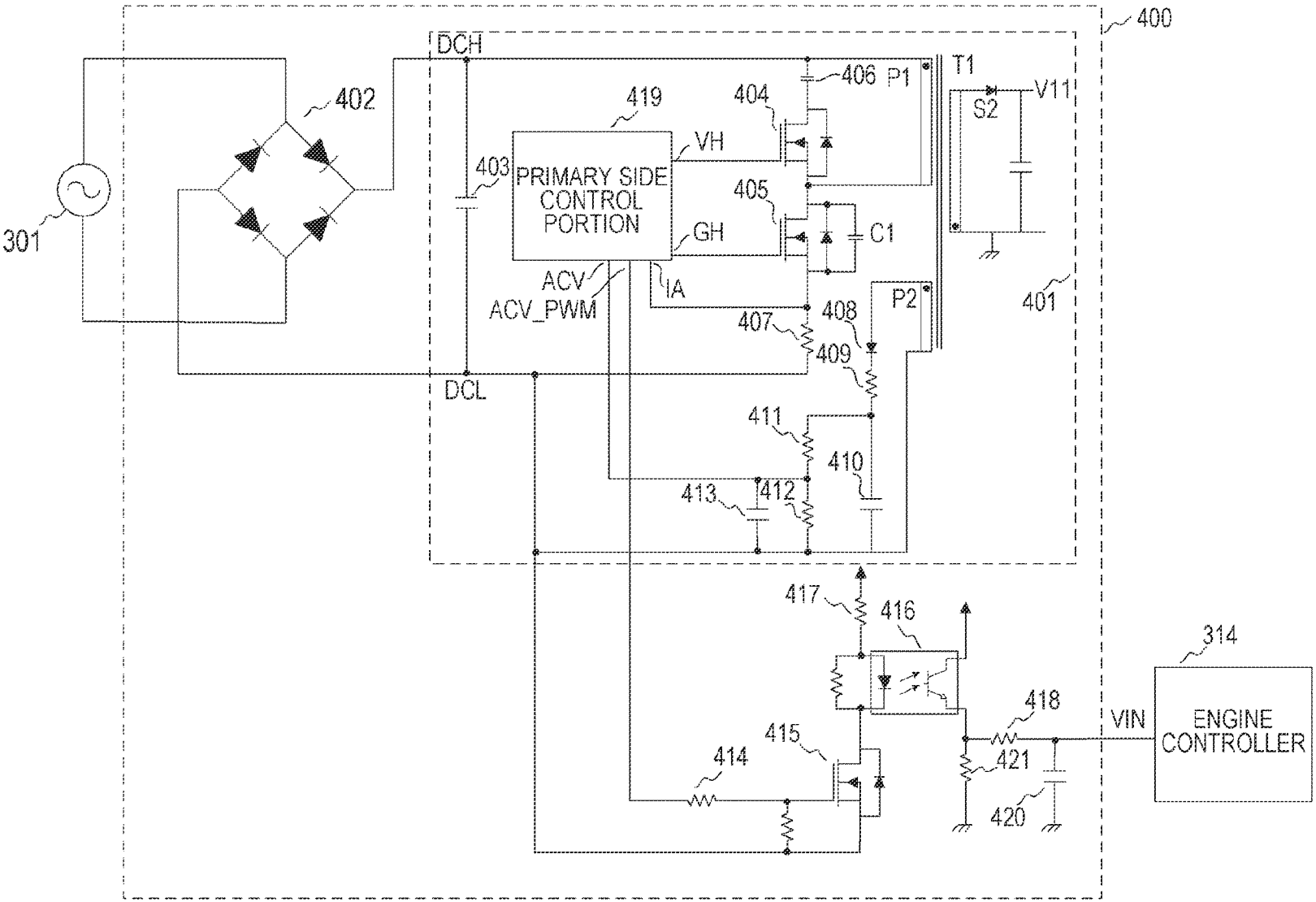
FIG. 4 is a diagram for describing a peak voltage detecting portion according to Embodiment 1.

FIG. 4 indicates a circuit diagram of the peak voltage detecting portion 400 according to Embodiment 1, which is a first peak voltage detecting portion. FIG. 4 indicates a part of a switching power supply device where an active clamp system is used for an insulating type convertor using a fly-back transfer, so as to convert the AC power, supplied from the commercial AC power supply 301 to DC power, and supply the power to the image forming apparatus. The commercial AC power supply 301, outputs AC voltage, and voltage rectified by a bridge diode 402 (full wave rectifying unit) is inputted to a switching power supply circuit 401. A smoothing capacitor 403 is used as a smoothing unit to smooth the rectified voltage, and the lower side potential of the smoothing capacitor 403 is denoted with DCL, and the higher side potential thereof is denoted with DCH. The switching power supply circuit 401 outputs the power supply voltage, such as a constant voltage V11 (e.g. 5V), from the input peak voltage charged in the smoothing capacitor C3 to an insulating secondary side. The switching power supply circuit 401 includes an insulating type transformer T1, which includes a primary coil P1 and an auxiliary coil P2 on the primary side and a secondary coil S1 on the secondary side. By the switching operation of an FET 404 and an FET 405 controlled by a primary side control portion 419, energy is supplied from the primary coil P1 to the secondary coil S1 in the transformer T1. The capacitor 406 used for clamping the voltage and the FET 404, which are connected in series, are connected to the primary coil P1 of the transformer T1 in parallel. The capacitor C1 for resonating the voltage, which is connected in parallel with the FET 405, is disposed to reduce loss of the FET 404 and the FET 405 when the switch is turned OFF. A resistor 407 is a current detecting resistor, and supplies voltage IA, which corresponds to a current load value, to the primary side control portion 419. The auxiliary coil P2 of the transformer T1 rectifies and smooths the forward voltage of the input peak voltage that is applied to the primary coil P1, using a diode 408, a resistor 409 and a capacitor 410, and this voltage is divided using a resistor 411 and a resistor 412, is smoothed by a capacitor 413, and is inputted to the primary side control portion 419 as a voltage ACV. The voltage of the ACV is a voltage that is in proportion to the input peak voltage. The primary side control portion 419 outputs a PWM signal generated by converting the voltage value of the ACV into a pulse width, and inputs it to the gate of the FET 415 via a resistor 414. Electric current is supplied to a photocoupler 416 via a resistor 417 in accordance with the switching of the FET 415. The pulse signal transferred to the secondary side via the photocoupler 416 is smoothed via a resistor 418, a resistor 421 and a capacitor 420, and is supplied to the engine controller 314 as a VIN signal.

As described above, the peak voltage detecting portion 400 according to Embodiment 1 converts the voltage, which is in proportion to the input peak voltage detected via the auxiliary coil P2 (a part of the switching power supply device 401), into a pulse signal, transfers the pulse signal to the secondary side, and smooths the pulse signal using the resistor 418 and the capacitor 420, whereby the VIN signal is transferred to the engine controller 314. Then the engine controller 314 can recognize the input voltage value by converting the VIN signal into the input peak voltage.

Figure 5:
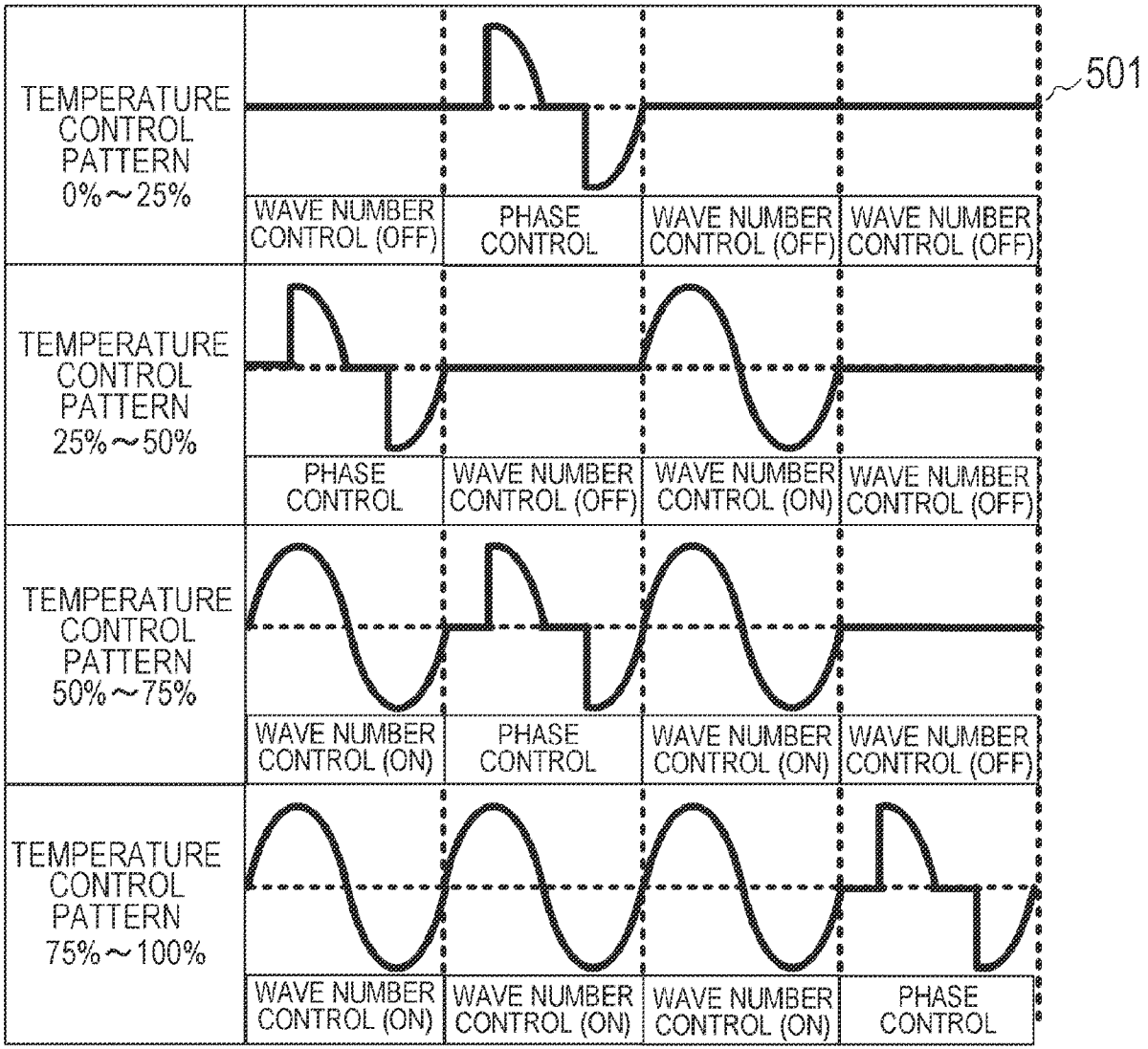
FIG. 5 is a diagram for describing a supply power pattern according to Embodiment 1.

FIG. 5 is a diagram indicating supply power patterns 501 that flow into the fixing apparatus 200 via the triac 303 when the engine controller 314 of Embodiment 1 supplies an ON1 signal to the power supply portion 302. Each supply power pattern 501 is based on the assumption that the power flowing into the fixing apparatus 200 is updated every four cycles (four full waves) of the commercial AC power supply, and FIG. 5 indicates the supply power patterns 501 when four full waves comprise one cycle of a control cycle (one control cycle). In a supply power pattern 501, when the power to be supplied to the fixing apparatus 200 is 0 to 25%, the first full wave is a wave number control (OFF), the second full wave is a phase control, the third full wave is a wave number control (OFF), and the fourth full wave is a wave number control (OFF), that is, in this control waveform, the wave number control (OFF) and the phase control are mixed in the four full waves. In the control waveform of the supply power pattern 501, when the power to be supplied to the fixing apparatus 200 is 25 to 100% as well, the wave number control (ON/OFF) and the phase control are mixed in the four full waves. Hereafter, the control waveform, in which the wave number control and the phase control are mixed, is referred to as "hybrid control". In Embodiment 1, the temperature control system of the power supply portion 302 via the ON1 signal supplied by the engine controller 314 is hybrid control as a standard, in which the wave number control and the phase control are mixed, as described in FIG. 5. In other words, in one control cycle, power is supplied by one of the waveform pattern of the wave number control; the waveform pattern of the phase control; and the control pattern combining the wave number control and the phase control.

Figure 6A:
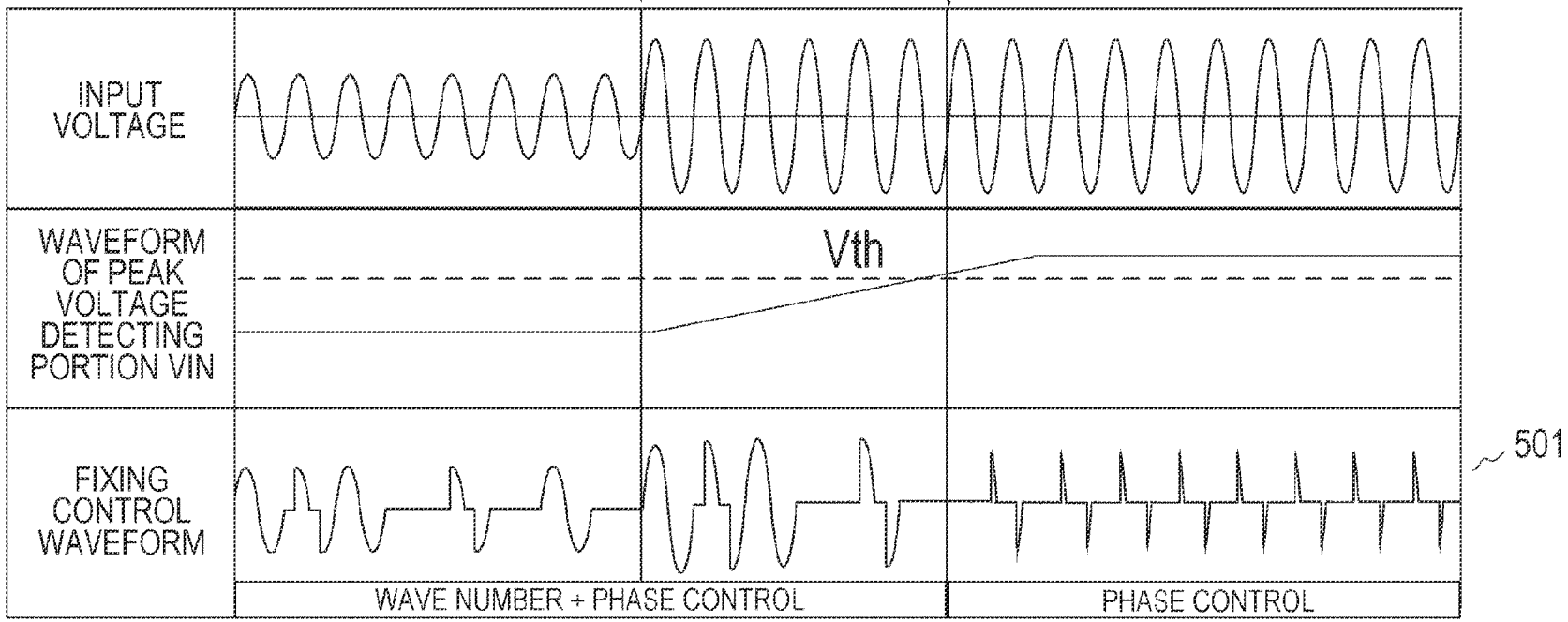
FIGS. 6A and 6B are diagrams for describing the circuit operation and supply power pattern according to Embodiment 1.
Figure 6B:
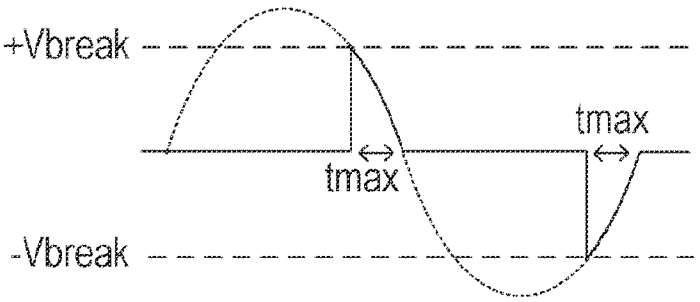

FIG. 6A is a diagram indicting the transition of the waveform of the peak voltage detecting portion VIN described in FIG. 4 and the transition of the supply power pattern 501, which characterizes Embodiment 1, in a case where the input voltage changes from the normal voltage to overvoltage. FIG. 6B indicates a method for controlling the supply power pattern 501 in a case where the engine controller 314, which is a detecting portion to detect whether the voltage applied from the commercial AC power supply exceeds a rated value or not, detected overvoltage. In FIG. 6A, the input voltage changes from a normal voltage to the overvoltage at timing A, since voltage exceeding the rated value was applied from the commercial AC power supply. In other words, the VIN signal of the peak voltage detecting portion 400 gradually increases from the timing A at a speed of the charges that are stored in the smoothing capacitor 403, and the voltage of the VIN signal saturates as the charges in the smoothing capacitor 403 saturate. The engine controller 314 judges an overvoltage when the voltage of VIN exceeds a predetermined voltage Vth (predetermined threshold). In FIGS. 6A and 6B, the timing when VIN exceeded the predetermined voltage Vth is the timing B. At the timing B when overvoltage was determined, the engine controller 314 immediately changes the supply power pattern 501 from the hybrid control described in FIG. 5 to the phase control waveforms alone. In FIG. 6B, ±Vbreak indicates the voltage threshold to prevent damage to the heating elements. The engine controller 314 stores a predetermined ON time tmax with which the supply power pattern 501 does not exceed ±Vbreak voltage, whereby the supply power pattern 501 is controlled such that the ON time of the ON1 signal does not exceed the time of tmax. The supply power pattern 501 indicated in FIG. 6B is an example of a waveform pattern of the phase control where in one full wave of one control cycle, the time when power is supplied to the heating elements in one half wave is within a predetermined time.

Figure 7:
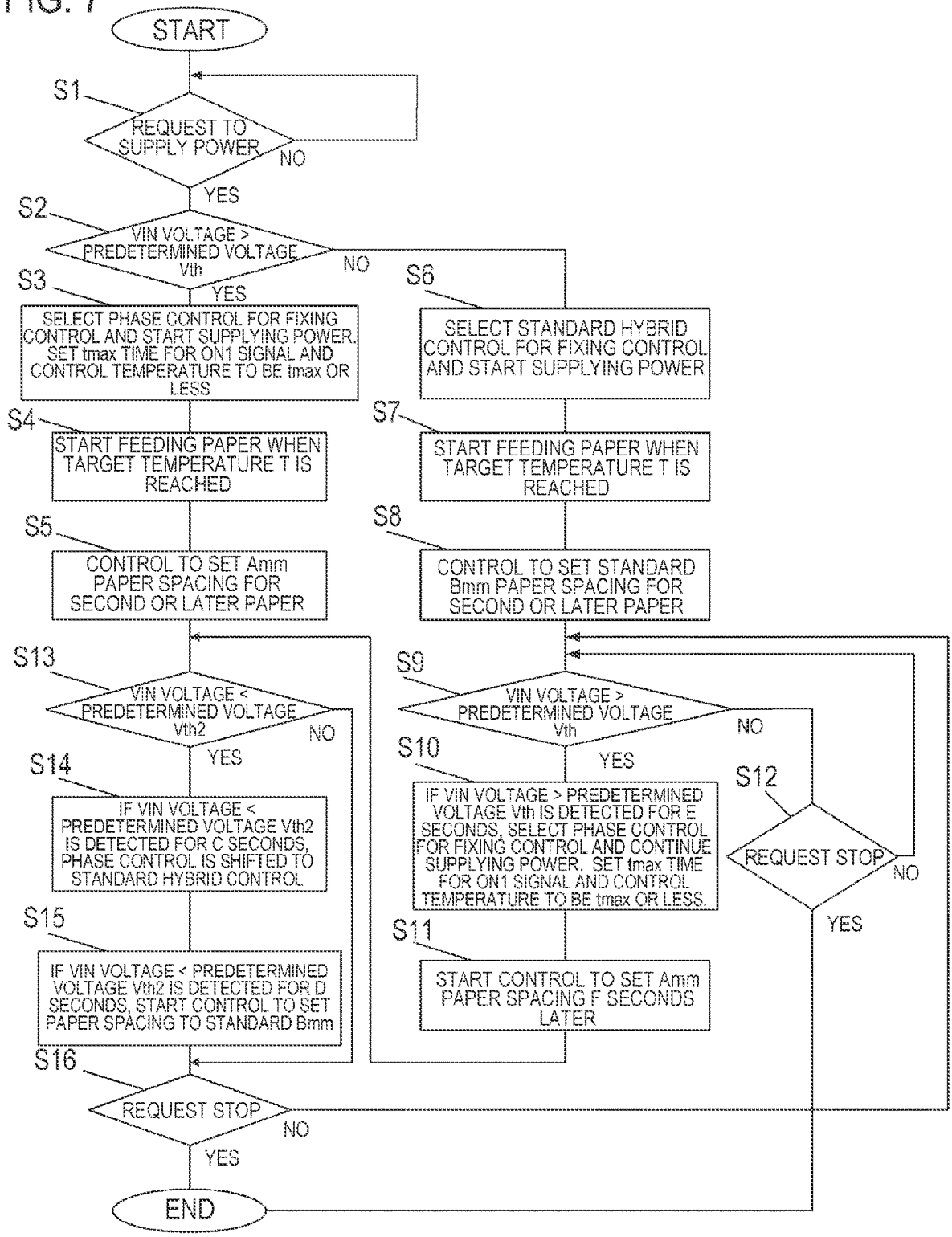
FIG. 7 is a control flow chart according to Embodiment 1.

FIG. 7 is a control flow chart of the engine controller 314 according to Embodiment 1. In S1, in a case where a printer request was received from a user, the engine controller 314 starts the request to supply power. In S2, processing advances to S3 if the VIN signal detected by the peak voltage detecting portion 400 exceeds the predetermined voltage Vth, or advances to S6 if the VIN signal is the predetermined voltage Vth or less. In S3, the engine controller 314 selects the phase control for the temperature control and starts supplying power. At this time, the tmax time is set for the ON1 signal, and the temperature control is started with the ON time which is tmax or less. In S4, when the temperature detected by the temperature detecting portion 212 reaches a target temperature T, the engine controller 314 starts feeding paper from the paper feeding cassette 11. In S5, it takes time to control the temperature to the target temperature since the power supplied to the fixing apparatus 200 is limited by the tmax time of the ON1 signal. Therefore a control, to set the paper feeding interval after the second paper to Amm, is executed. In other words, images are formed continuously on a plurality of recording materials, and the conveying intervals of the plurality of recording materials are set longer when continuous paper feeding, to heat the images continuously, is performed. Thereby power required for the fixing apparatus 200 to fix the images is decreased. Then processing advances to S13.

In S6, the engine controller 314 selects the standard hybrid control for the temperature control, and starts supplying power. In S7, when the temperature detected by the temperature detecting portion 212 reaches the target temperature T, the engine controller 314 starts feeding paper from the paper feeding cassette 11. In S8, control, to set the paper feeding interval after the second paper to standard Bmm, is executed. In S9, it is detected whether the VIN signal exceeded a predetermined voltage Vth during paper feeding, and processing advances to S10 if exceeded, or to S12 if not. In S10, the engine controller 314 shifts the standard hybrid control to the phase control if the VIN signal>voltage Vth is detected for E seconds. E seconds is a chattering time. In S11, the engine controller 314 executes a control to set the paper interval to Amm if VIN signal>voltage Vth is detected for F seconds, and processing advances to S13. F seconds is a chattering time. When the engine controller 314 determines to stop printing in S12, the temperature control and the print control are stopped, and processing is ended. Processing returns to S9 if the stop request is not received. In S13, it is detected whether the VIN signal dropped to a predetermined voltage Vth2 or less during paper feeding, and processing advances to S14 is dropped, or to S16 is not. For the voltage of Vth2, a hysteresis relationship of Vth1≥Vth2 may be set to stabilize control. In S14, the engine controller 314 shifts the phase control to the standard hybrid control if VIN signal<voltage Vth2 is detected for C seconds. C seconds is a chattering time. In S15, the engine controller 314 shifts to a control to set a paper interval to standard Bmm if VIN signal<voltage Vth2 is detected for D seconds. When the engine controller 314 determines to stop printing in S16, the temperature control and the print control are stopped, and processing is ended. Processing returns to S9 if the stop request is not received.

As described above, the sequence to control the overvoltage applied to the heating elements of Embodiment 1 has the following characteristics.

When the peak voltage exceeds a predetermined voltage, the temperature control is changed to the phase control.

At this time, it is controlled such that the ON1 signal, to drive the triac 303, does not become ON for a predetermined time or longer.

The paper interval is set to Amm which is wider than the standard Bmm (A>B).

According to Embodiment 1, the overvoltage applied to the heating elements can be suppressed, hence damage to the heating elements can be easily avoided.

Embodiment 2

Figure 8:
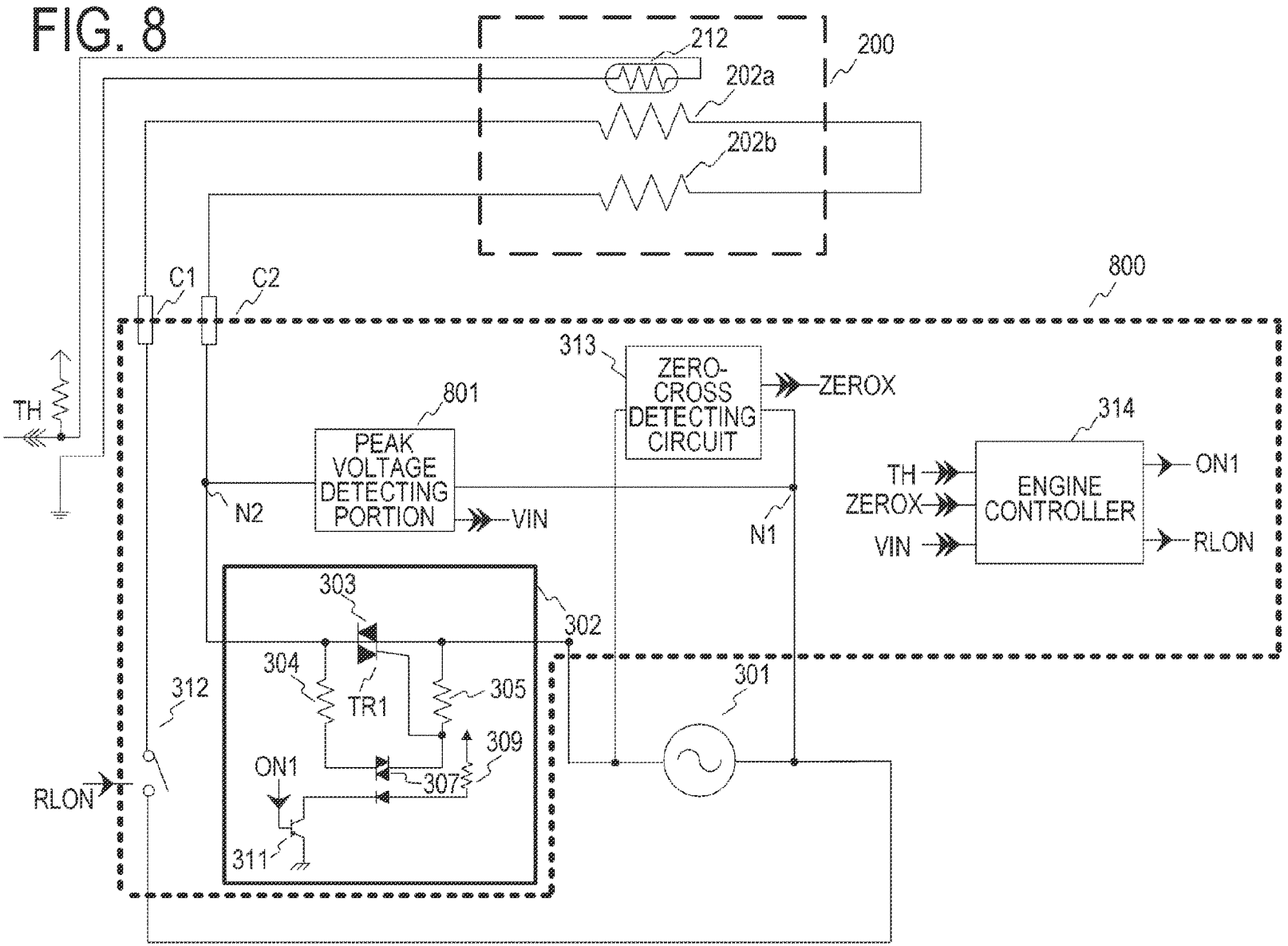
FIG. 8 is a control circuit diagram according to Embodiment 2.

FIG. 8 indicates a control circuit 800 according to Embodiment 2 that supplies power from the commercial AC power supply 301 to the fixing apparatus 200. The control circuit 800 is constituted of the power supply portion 302, the zero-cross detecting circuit portion 313, a peak voltage detecting portion 801, the relay 312 and the engine controller 314, and here the peak voltage detecting portion 801, which is a characteristic of Embodiment 2, will be described. One side of the peak voltage detecting portion 801 is connected with the commercial power supply 301 at a location N1, and the other side is electrically connected with the image heating apparatus at a location N2, so that the peak voltage detecting portion 801 detects voltage applied to the fixing apparatus 200.

Figure 9:
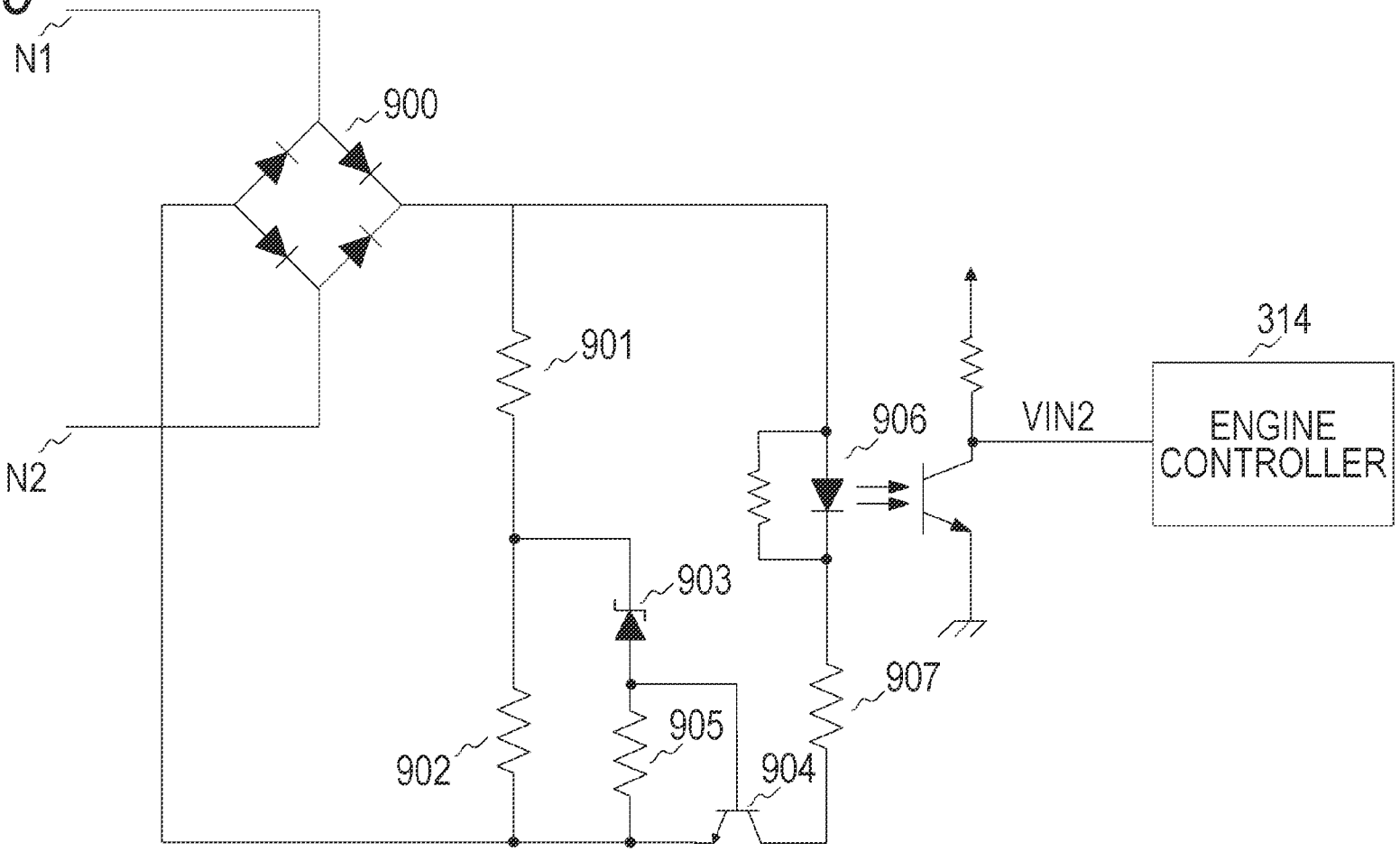
FIG. 9 is a diagram for describing a peak voltage detecting portion according to Embodiment 2.

FIG. 9 indicates a circuit diagram of the peak voltage detecting portion 801 according to Embodiment 2, which is a second peak voltage detecting portion. The voltages supplied from N1 and N2, which are connected to the fixing apparatus 200, are rectified by a diode array 900. The rectified voltage is divided by the resistors 901 and 902, and are applied to a Zener diode 903. The threshold Vth of the peak voltage that is applied to the image heating apparatus is determined by the divided voltage values of the resistors 901 and 902 and the voltage of the Zener diode. If voltage exceeding the Zener voltage is applied to the resistor 902, voltage is applied to a base of a transistor 904 and a base resistor 905, and the transistor 904 is turned ON. When the transistor 904 turns ON, electric current limited by a resistor 907 flows into a primary side LED of a photocoupler 906, and a secondary side transistor turns ON. As a result, the VIN2 signal, inputted to the engine controller 314, changes from HIGH to LOW.

As described above, the peak voltage detecting portion 801, according to Embodiment 2, sets the voltage threshold to prevent damage to the heating elements using the divided voltages of the resistors 901 and 902 and the voltage of the Zener diode 903, and transfers the binary information, indicating whether each threshold is exceeded or not, to the engine controller 314.

Figure 10:
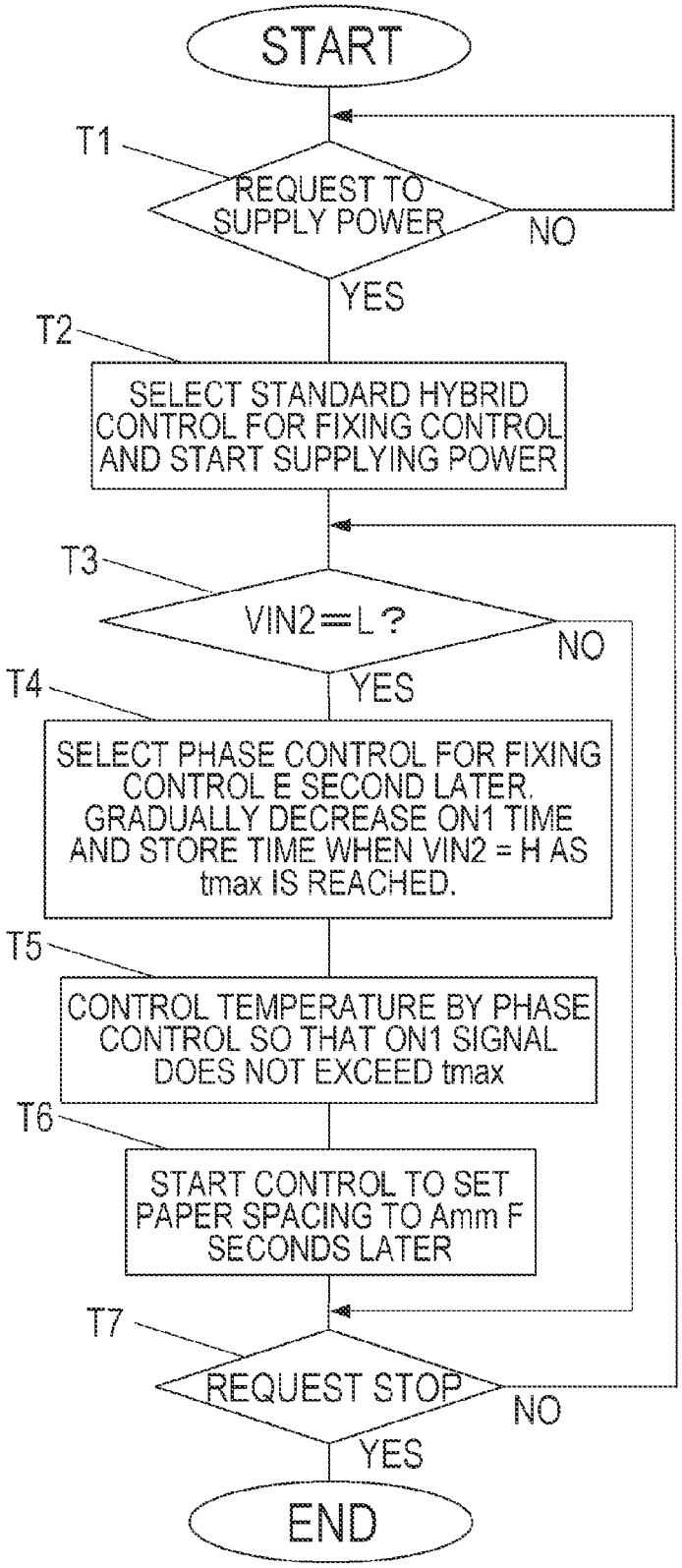
FIG. 10 is a control flow chart according to Embodiment 2.

FIG. 10 is a control flow chart of the engine controller 314 according to Embodiment 2. In T1, the engine controller 314 starts a request to supply power if a print request is received from a user. In T2, the engine controller 314 selects the standard hybrid control for the temperature control, and starts supplying power. In T3, the engine controller 314 determines whether the VIN2 signal detected by the peak voltage detecting portion 801 is LOW, and processing advances to T4 if the VIN2 signal is LOW, or advances to T7 if the VIN2 signal is HIGH. In T4, the engine controller 314 selects the phase control for the temperature control and continues supplying power if LOW of the VIN2 signal is detected for E seconds. E seconds is a chattering time. Then the engine controller 314 gradually decreases the power supplying time of the triac 303 by the ON1 signal, and stores the time when VIN2=L changed to H as tmax. In other words, the engine controller 314 acquires tmax, which is a predetermined power supplying time at which the peak voltage, detected by the peak voltage detecting portion 801, becomes a second predetermined threshold or less in order to prevent applying overvoltage. In T5, the temperature control by the phase control is continued so that the ON1 signal does not exceed tmax. In T6, the engine controller 314 starts a control to set paper interval to Amm if LOW of the VIN2 signal is detected for F seconds. F seconds is a chattering time. When the engine controller 314 determines to stop printing in T7, the temperature control and the print control are stopped, and processing is ended. Processing returns to T3 if the stop request is not received.

As described above, the sequence to suppress the overvoltage applied to the heating elements of Embodiment 2 has the following characteristics.

The peak voltage detecting portion 801 detects voltage that is applied to the heating elements.

The ON time of the ON1 signal, where overvoltage is not applied to the heating elements, is detected, and after the ON time is detected, the ON1 signal is limited so as not to exceed the ON time.

According to Embodiment 2, the overvoltage applied to the heating elements can be directly detected and suppressed, hence damage to the heating elements can be avoided with more accuracy than Embodiment 1.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-009483, filed on Jan. 25, 2021, which is hereby incorporated by reference herein in its entirety.

What is claimed is:

1. An image forming apparatus comprising:

an image forming portion that forms an image on a recording material;

a heating portion that includes a heating element that is heated by power supplied from a commercial AC power supply and heats an image formed by the image forming portion;

a temperature detecting portion that detects temperature of the heating portion; and a power control portion that controls power supplied from the commercial AC power supply to the heating element based on temperature information detected by the temperature detecting portion, wherein the image forming apparatus further comprises a detecting portion that detects whether voltage applied from the commercial AC power supply exceeds a rated value of the commercial AC power, and wherein, in a case where the detecting portion detects that the voltage applied from the commercial AC power supply exceeds the rated value, the power control portion controls the power supply such that a waveform pattern of an electric current flowing to the heating element in one control cycle becomes a waveform pattern of phase control, where power supplying time to the heating element in one half wave becomes a predetermined time or less.

2. The image forming apparatus according to claim 1, wherein, in a case where the detecting portion detects that the voltage applied from the commercial AC power supply does not exceed the rated value, the power control portion controls the power supply such that a waveform pattern of the electric current flowing to the heating element in one control cycle becomes any one of a waveform pattern of a wave number control, a waveform pattern of a phase control, and a control pattern combining the wave number control and the phase control.

3. The image forming apparatus according to claim 1, wherein the detecting portion includes a peak voltage detecting portion that detects a peak voltage applied from the commercial AC power supply to the image forming apparatus, and the detecting portion detects that the voltage applied from the commercial AC power supply exceeds a rated value in a case where the peak voltage detected by the peak voltage detecting portion exceeds a predetermined threshold.

4. The image forming apparatus according to claim 1, wherein the detecting portion includes a peak voltage detecting portion that detects a peak voltage applied from the commercial AC power supply to the heating element, and the detecting portion detects that the voltage applied from the commercial AC power supply exceeds a rated value in a case where the peak voltage detected by the peak voltage detecting portion exceeds a predetermined threshold.

5. The image forming apparatus according to claim 4, wherein, in the power supply in a waveform pattern of the phase control where the power supplying time to the heating element in one half wave is within a predetermined time in one control cycle, the power control portion gradually decreases the power supplying time to the heating element in one half wave, and detects a predetermined power supplying time at which the peak voltage detected by the peak voltage detecting portion becomes a second predetermined threshold or less, and after the detection, the power control portion controls the power supply such that the power supplying time to the heating element in one half wave does not exceed the predetermined power supplying time.

6. The image forming apparatus according to claim 1, wherein, in a case where the detecting portion detects that the voltage applied from the commercial AC power supply exceeds the rated value, the image forming portion forms images continuously on a plurality of recording materials, and sets a conveying interval of the plurality of recording materials, during continuous paper feeding in which the images are heated continuously, to be longer than the conveying interval in a case where the detecting portion detects that the voltage applied from the commercial AC power supply does not exceed the rated value.

7. The image forming apparatus according to claim 1, wherein the heating portion further comprises a heater including the heating element, and a cylindrical film of which inner surface is contacted by the heater, and the heating portion heats the image via the film.

8. The image forming apparatus according to claim 7, wherein the heating portion further comprises a roller contacting an outer surface of the film to form a nip portion through which the recording material bearing the image passes in cooperation with the heater via the film.

* * * * *